US009434534B2

(12) United States Patent
Whitener

(10) Patent No.: US 9,434,534 B2
(45) Date of Patent: Sep. 6, 2016

(54) RETENTION TANK STORAGE COVER

(71) Applicant: Michael Whitener, Ft. Myers, FL (US)

(72) Inventor: Michael Whitener, Ft. Myers, FL (US)

( * ) Notice: Subject to any disclaimer, the term of this patent is extended or adjusted under 35 U.S.C. 154(b) by 0 days.

(21) Appl. No.: 14/248,049

(22) Filed: Apr. 8, 2014

(65) Prior Publication Data

US 2015/0284924 A1 Oct. 8, 2015

(51) Int. Cl.
*B65D 88/34* (2006.01)
*B65D 88/36* (2006.01)
*E02B 1/00* (2006.01)

(52) U.S. Cl.
CPC *B65D 88/34* (2013.01); *E02B 1/00* (2013.01)

(58) Field of Classification Search
CPC ..... B65D 88/34; B65D 88/36; B65D 90/42; E02B 1/00
USPC ..... 220/216, 218
See application file for complete search history.

(56) References Cited

U.S. PATENT DOCUMENTS 3,158,667 A * 11/1964 Michaels ..... 264/46.7
3,592,009 A 7/1971 Glijnis
3,903,701 A 9/1975 Gauch
3,993,214 A 11/1976 Usab
RE30,146 E * 11/1979 Dial et al. ..... 220/219
4,244,819 A 1/1981 Ballu
5,074,427 A 12/1991 Siemering
6,357,964 B1 3/2002 DeGarie
6,659,688 B2 12/2003 Baumgartner
6,851,891 B2 2/2005 Baumgartner
8,132,364 B2 3/2012 Kania
2002/0131822 A1* 9/2002 Hill ..... 405/52
2007/0221562 A1* 9/2007 Van Hoof et al. ..... 210/242.1
2009/0139927 A1 6/2009 Kania
2009/0288341 A1* 11/2009 Kania et al. ..... 47/64
2011/0000415 A1* 1/2011 Alshaikh et al. ..... 112/401
2011/0005133 A1 1/2011 Kania
2013/0019791 A1* 1/2013 Schmidt et al. ..... 114/264
2013/0125825 A1* 5/2013 Kania et al. ..... 119/221

FOREIGN PATENT DOCUMENTS

JP 2003/125695 5/2003

* cited by examiner

*Primary Examiner* — J. Gregory Pickett
*Assistant Examiner* — Niki M Eloshway
(74) *Attorney, Agent, or Firm* — David McEwing

(57) ABSTRACT

The disclosure teaches a polyurea coated water storage floatation cover comprising a layer of buoyant closed cell foam coated with polyurea, a upper layer of polyurea coated textile attached to the buoyant closed cell foam coated with polyurea, and attachment components affixed to the upper layer of the polyurea coated textile. The cover can be rolled up for storage and transportation. The cover can be reused. The cover can be made in sections that can be attached together to cover a large area of water surface such as in a retention pond or open top tank.

17 Claims, 1 Drawing Sheet

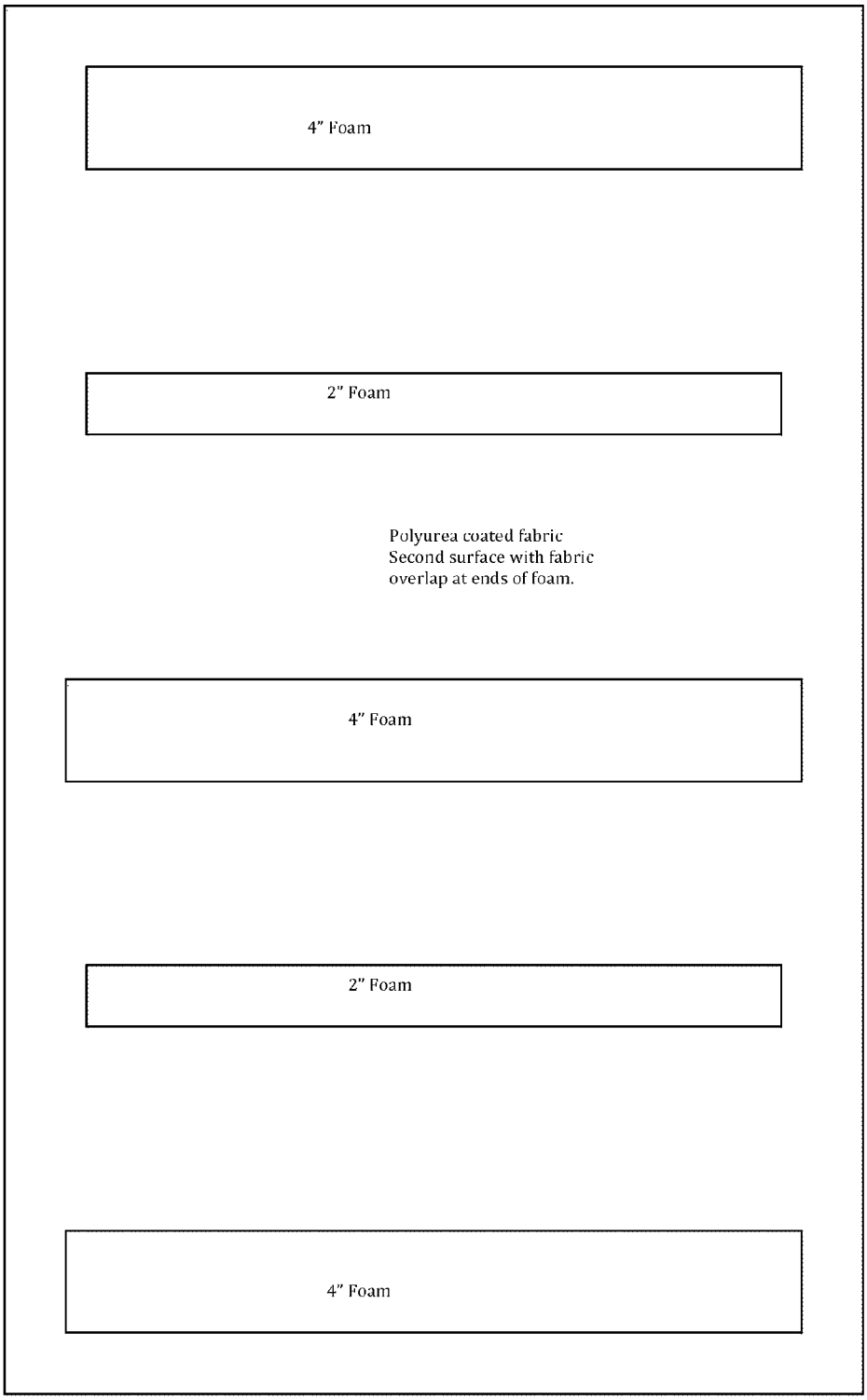
4" Foam
2" Foam
Polyurea coated fabric
Second surface with fabric
overlap at ends of foam.
4" Foam
2" Foam
4" Foam

RETENTION TANK STORAGE COVER

SUMMARY OF DISCLOSURE

1. Field of Use

Large quantities of water are used in the fracking industry. The water may be stored in water tanks, ponds, earthen pits and retention ponds (hereinafter water storage tanks). The water is preferably kept within a specified temperature range. This allows the water to be more readily mixed with chemical additives prior to the fracking operation. The water containing additives is pumped under ground under high pressure to fracture a geologic formation. This is part of the well completion for hydrocarbon production. The water may be treated prior to disposal. This also results in large quantities of water being stored in water tanks, ponds, earthen pits and retention ponds. When exposed to low ambient temperature, there is a loss of heat. In summer, there is a problem with evaporation of the water. As used in this disclosure water includes water containing chemical additives or contaminants.

2. Prior Art

Covers for the retention ponds and storage tanks have been fabricated using HDPE. However the HDPE degrades from UV radiation and in combination with the frack components or additives. The HDPE can become embrittled and cracked. This degradation makes the HDPE covering unsuitable for multiple uses as a storage tank cover. A foam gel has also been utilized as a covering. However this material also degrades or disperses and is unsuitable for multiple applications.

SUMMARY OF INVENTION

A novel covering material has been developed. This material covers the surface of water retention ponds and tanks (water storage tanks). The covering comprises a polyurea coating sprayed over a geotextile in combination with buoyant material such as a closed or open cell foam or other buoyant structures. The buoyancy is engineered with the size, weight and shape of the coated fabric covering. The combined covering is engineered to have sufficient buoyancy to hold the covering substantially at the water surface. Portions of the covering may be suspended beneath the water surface. The covering floats or is suspended at the water level surface or immediately below the surface. The disclosure describes a covering that is positioned substantially at the surface without protruding from the water surface. The covering is thereby stably positioned and not likely to be blown off the water surface by high wind currents.

The foam material or other buoyant material may be spray coated with polyurea. The polyurea forms a flexible material coating. The coating can protect the buoyant structure, e.g., foam, from damage during handling in storage, transportation and installation. The covering may also comprise a textile coated with polyurea. The polyurea coating causes the textile and buoyant material to be impervious to water. In one embodiment, the polyurea coated textile can be used as a covering for the coated foam. The foam may be attached to the textile with adhesive or other devices. In one embodiment, the foam may be mechanically attached such as with rivets and grommets. In another embodiment, the floatation component can be enclosed in the coated fabric. This enclosure mechanism can be in the form of stitched pockets in which the floatation component is inserted.

SUMMARY OF DRAWINGS

The accompanying drawings, which are incorporated in and constitute a part of the specification, illustrate preferred embodiments of the invention. These drawings, together with the general description of the invention given above and the detailed description of the preferred embodiments given below, serve to explain the principles of the invention.

FIG. 1 illustrates the second side of the polyurea coated fabric with the foam sections sized and placed to achieve the desired buoyancy of the combined coated fabric and floatation component, e.g., coated or uncoated foam.

DETAILED DESCRIPTION OF DISCLOSURE

The water covering material can be required to cover large water surface areas. Tanks may have a top surface area of over 21,000 sq. ft. and hold 1.2 Million gallons of water. To create an effective covering, the disclosure includes creation of sectioned coverings of fabric. These covering may be 15 feet wide and 80 long. Other dimensions may be used. The fabricated coverings can be rolled into tube shapes for storage and transportation and installation.

In one embodiment, the fabric covering comprises an approximate 0.125 inch layer of a geotextile fabric. In one embodiment, the fabric is a polyspun 4 oz typar. It may be spunbonded polypropylene available from DuPont de Nemours. Other materials may be used. The geotextile can be a woven fabric or biaxial geotextile. It can also be a membrane.

The fabric is unrolled or unfolded (deployed) on a flat surface in an environmentally controlled area. The flat deployed fabric is protected from weather elements, e.g., wind and rain. The fabric has a first surface and a second surface. The first surface of the fabric can be spray coated with between 30 and 60 mil of polyurea. During this operation, the second fabric surface is positioned on the flat floor surface. The spraying of the first surface can be performed by a robot as disclosed in Applicant's pending application Ser. No. 13/435,093 filed Mar. 30, 2012 which is incorporated by reference herein in its entirety. The robotic sprayer disperses a uniform layer of coating. This ensures the coating is impervious to water. It also ensures that too much coating is not sprayed upon the fabric. The coating has weight and too much coating can impact the engineered buoyancy of the covering, i.e., the relationship between the weight of the fabric and the buoyancy of the foam.

The coated fabric is allowed to cure while remaining in a flat position. Preferably the flat surface holding the fabric is maintained in an enclosed structure. The foam and fabric can also be sprayed manually.

The cured fabric is reversed, i.e., the second surface (uncoated) is placed on top. The coated first surface is placed on the flat floor surface. Sections of buoyant material are placed on the uncoated fabric (second fabric surface). The robotic or hand spraying of the fabric and foam is repeated. The material may be flexible 4 lb. closed cell foam. The material can be Styrofoam or similar rigid or non rigid water buoyant material. The material can be flexible open cell foam. The second surface and floatation component, e.g., closed cell foam, is sprayed with a 30 to 60 mil thickness of coating. It will be appreciated that the floatation component such as open or closed cell foam has been engineered (dimensioned) compatible with the weight of the coated fabric to allow the combination to hover at or beneath the water surface. The specific gravity of foam and liner is engineered to be near the specific gravity of the water at the surface. The covering remains suspended in the water. It will also be appreciated that the positioning of the floatation components are engineered to facilitate uniform suspension of the covering in the water. The covering floats up and down and doesn't need to be anchored to the bottom or sides of the tank or pond. Portions of the covering directly supported underneath by a foam component may extend out of the water. The floatation devices may entrap air under the covering further enhancing buoyancy.

In one embodiment, the foam sections of approximately 10 or 6 feet long (depending on width of fabric) by 1 foot wide by 4 inches thick are placed at approximately 20 foot intervals on the 80 foot long textile. Additional foam panels can be placed on the uncoated fabric. The spacing of the foam panels can be varied as part of the engineering of the weight and buoyancy. FIG. 1 illustrates one embodiment of placement of the foam panels on the fabric. The 4 inch thick sections of foam are place proximate to each end of the fabric. In an other embodiment, a two inch thick section of foam can be placed proximate to the ends. It will be appreciated other dimensions may be used so that the buoyance of the assembled cover approximates the buoyancy of the water at the surface. An overlap of fabric is maintained, i.e., the edges of the fabric extend past the ends of the foam sections. This is illustrated in FIG. 1. A center section of 4 inch thick foam is attached. Between the 4 inch foam section are sections of less buoyant 2 inch thick foam. It will be appreciated that this is an example only and other configurations are within the scope of this invention.

The sections of foam may be adhesively bonded to the textile. In one embodiment, the polyurea coating is used as the adhesive between the fabric and the foam. Other devices such as bladders or airtight containers can also be also be used as floatation devices. Other embodiments can be flexible structures creating an interstitial space holding air for buoyancy. The floatation components may be mechanically attached to the fabric, i.e., stitching or rivets and grommets.

The fabric/foam combination can be spray coated with polyurea coating as previously described. This double coating (coating of the first and second fabric surfaces) makes the fabric impervious to water. The coating also retards any absorption of water by the closed cell foam. It will be appreciated open cell foam may be utilized or gas filled bladders, e.g., air filled.

In one embodiment, the edges of the first coated fabric surface, (now placed against the floor surface) are curled upward. The coating imparts sufficient stiffness that the coated edges remain curled during the second spraying operation. It will be appreciated that the second spraying operation occurs with the foam pieces adhesively attached to the second side of the fabric. The curled edges facilitate fixing attachment mechanisms to the fabric edges.

In one embodiment, the foam is selectively positioned on the uncoated fabric to achieve desired location and quantity of buoyancy when placed in water. It will be appreciated that the foam sections are placed on the underside of the approximately 80 foot long section of fabric. Stated differently, the second fabric surface, containing the adhesively bonded foam sections, are placed against the surface of the water. The foam is buoyant in the water. The foam is positioned to facilitate the entrapment of air under the coated fabric. This improves the buoyancy of the fabric as will be discussed further below.

The foam can be laid out on a large flat surface and robotically sprayed with a selected uniform thickness of polyurea coating. In one embodiment, the coating is 60 mils thick. In a different embodiment, the coating can be 30 mils thick. Preferably, the large flat surface is environmentally protected, i.e., and enclosed from wind and rain or other environmental elements. In one embodiment the enclosure is temperature and humidity controlled. Temperature and humidity control can facilitate rapid curing of the sprayed coating.

The textile fabric can be larger than the 10 foot length of the foam section. The textile can be 15 feet wide. This provides a fabric overlap. This can be useful in positioning multiple textile sections together across the water surface.

The fabric, being larger than the foam, has an edge which can be overlapped with an adjoining covering section. It will be appreciated that the multiple sections of foam and fabric coverings are fabricated. Enough sections are required to cover the surface of the retention or storage tank. These structures may have surface areas of approximately 12,000 sq. ft. Depending upon the geometry of the tank, it would take 10 or more sections (15 by 80 feet) to cover the surface.

In one embodiment, the covering sections can be joined together. This can be accomplished with hook and loop fasteners (sold under the trade name Velcro). One section can have a portion of the hook fastener and the next section can have the complementary loop fastener. The fastener components can be affixed to the overlapping edges as described in the preceding paragraph.

In another embodiment, the fabric covering can contain loops on the top surface. The loops can be tied together, i.e., the loops of one floatation section can be tied to the loops of a second adjoining section. Straps may be utilized. The straps may be adjustable in length. The straps may be connected with spring latch fasteners or plastic buckles of the type commercially available from USA Lanyard Supply, www.lanyardsupply.com.

It will be appreciated that the polyurea coated textile is weather impenetrable and are suitable for outdoor use. The coating can be a dark color, e.g., black, to absorb radiant heat energy from the sun and warm the water beneath the covering. The floatation component, e.g., foam retains the covering above or at the water surface but also provide buoyancy under snow loads. The covering can be used in a four seasons environment. The covering also retards the rate of evaporation from the water surface.

In another embodiment, the edges of the sections of coated foam and fabric can be shaped to conform to the edges of the retention or storage tank. Stated differently, the sections can have a radius to conform to the shape of a circular tank. The buoyant floatation devices also eliminate the need for nets to be placed over the surface of the water. It has been found that birds flock to the water and drown thereby contaminating the water. The floatation devices provide a landing stage and the birds can be rescued if necessary. The disclosure of this application does not require the use of covering nets.

The coated closed cell foam components supply the buoyancy for the coated textile. In the sections of the textile not directly support by underlying foam, the textile lays flat substantially on the surface of the water. The textile, coated with 30 to 60 mils of polyurea on both sides, coupled with the buoyancy of the floatation components, is maintained at the water surface. The position of the floatation devices can be selected to achieve the desired buoyancy. In one embodiment, 4 inch floatation foam is positioned approximately 20 to 30 feet apart with thinner sections of foam (1-2 inches thick), spaced between the 4 inch foam sections. The foam sections can be approximately 14 feet long and 2-4 feet wide. The cover does not protrude above the water surface. Segments unsupported by buoyant foam may dip below the water surface. It will be appreciated that the covering does not form an obstacle to air currents blowing across the water surface. Without being bound by theory, it is assumed the covering has a net buoyancy approximately equal to the water at the surface. Therefore the cover is not blown off the water surface in high winds. The floatation cover does not need to be anchored.

In another embodiment, two layers of textile are used. Air is trapped between the layers. This provides buoyancy.

In another embodiment, a ½ to 1 inch thick sheet of foam can be adhesively applied in a large sheet to the second side of the fabric, thereby providing the desired buoyancy.

The coated fabric can be reused. The material can be rolled up for storage and transportation transported to another location for installation. The coated fabric is not degraded by the frack water and is UV stable.

This specification is to be construed as illustrative only and is for the purpose of teaching those skilled in the art the manner of carrying out the invention. It is to be understood that the forms of the invention herein shown and described are to be taken as the presently preferred embodiments. As already stated, various changes may be made in the shape, size and arrangement of components or adjustments made in the steps of the method without departing from the scope of this invention. For example, equivalent elements may be substituted for those illustrated and described herein and certain features of the invention maybe utilized independently of the use of other features, all as would be apparent to one skilled in the art after having the benefit of this description of the invention.

While specific embodiments have been illustrated and described, numerous modifications are possible without departing from the spirit of the invention, and the scope of protection is only limited by the scope of the accompanying claims.

What I claim is:

1. A polyurea coated water storage floatation cover comprising:

a) at least a single layer section of non buoyant water impervious comprising coated fibers, fabric or geotextile having a first upper side and a second underside;

b) floatation sections which are selectively and separately attached to the non buoyant water impervious cover wherein a combination of the plurality of attached floatation sections to the non buoyant water impervious cover section forms a buoyant substantially flat panel;

c) each of the plurality of selectively dimensioned floatation sections are sprayed with water imperious coating and attached to the second underside of the non buoyant water impervious continuous liner;

d) a plurality of positioned and dimensioned floatation sections attached to the non buoyant water impervious cover wherein neither the dimensioned floatation sections nor the non buoyant impervious cover comprise a metal or rigid frame nor are the floatation sections and non buoyant impervious cover anchored or tethered;

e) the plurality of positioned and dimensioned floatation sections attached to the non buoyant water impervious cover in a selected pattern wherein the positioned and dimensioned floatation sections are configured to achieve a combined buoyancy with the water impervious cover to maintain the water impervious covering substantially at a fluid surface level; and f) one or more complementary detachable fasteners attaching one buoyant substantially flat panel to one or more other buoyant substantially flat panel.

2. The water storage floatation cover of claim 1 further comprising floatation sections of buoyant foam.

3. The water storage floatation cover of claim 2 wherein the buoyant foam is flexible.

4. The water storage floatation cover of claim 2 wherein the buoyant foam is compressible.

5. The water storage floatation cover of claim 2 wherein the floatation components comprise buoyant foam sprayed with polyurea coating.

6. The water storage floatation cover of claim 1 further comprising a fabric sprayed with water impervious polyurea.

7. The water storage floatation cover of claim 6 further comprising spraying the first upper side and the second underside with polyurea.

8. The water storage floatation cover of claim 1 further comprising floatation components sized and positioned on the water impervious fabric to support the water impervious fabric substantially at the surface of the water.

9. The water storage floatation cover of claim 8 further comprising the water storage floatation liner without an anchor or attachment to a side or bottom of a water retention tank or pond.

10. The floatation cover of claim 1 further comprising closed cell foam attached to first upper surface.

11. The floatation cover of claim 1 further comprising a layer of buoyant closed cell foam attached to a second bottom surface.

12. The floatation cover of claim 1 further comprising a plurality of sections of buoyant closed cell foam.

13. A polyurea coated storage floatation cover section comprising:

a) at least a layer of buoyant floatation section coated with a fluid impervious layer of polyurea;

b) a textile coated with a water impervious layer of polyurea having a first top surface and a second bottom surface wherein a plurality of separated buoyant floatation sections are selectively positioned by attachment to a surface of the textile to form a buoyant substantially flat panel;

c) the buoyant flat panel has a selected buoyancy by dimension and position of the buoyant floatation sections to suspend the buoyant flat panel substantially at a fluid surface; and d) one or more detachable fasteners attached to one or more buoyant flat panels and complementary fastener attached to one or more separate buoyant flat panel creating a buoyant covering structure comprised of a plurality of buoyant substantially flat panels.

14. The floatation cover of claim 13 further comprising a plurality of buoyant flat panels configured to be attached together in a pattern to match the shape of a top of a water storage tank or pond.

15. The floatation cover of claim 13 wherein the at least one section of buoyant closed cell foam has a different shape than another section.

16. A combination of polyurea coated water storage floatation panels of claim 13 wherein the combined shape of the polyurea coated water storage floatation panels substantially matches the surface shape.

17. The combination of attached polyurea coated water storage floatation panels of claim 16 without anchors or attachments to the sides or bottom of the body of water.

* * * * *